US005203562A

United States Patent [19]

Smith

[11] Patent Number: 5,203,562

[45] Date of Patent: Apr. 20, 1993

[54] DICE CONSTRUCTION

[76] Inventor: Mark V. Smith, 417 W. Milwaukee, Apt. 3, Janesville, Wis. 53545

[21] Appl. No.: 900,653

[22] Filed: Jun. 19, 1992

[51] Int. Cl.[5] ..... A63F 9/04

[52] U.S. Cl. ..... 273/146

[58] Field of Search ..... 273/146, 245-247

[56] References Cited

U.S. PATENT DOCUMENTS

| | | | |
|---|---|---|---|
| 1,271,551 | 7/1918 | Ebner et al. | 273/146 |
| 5,031,915 | 7/1991 | Sanditen | 273/146 |
| 5,114,147 | 5/1992 | Faylo | 273/146 |

FOREIGN PATENT DOCUMENTS

| | | | |
|---|---|---|---|
| 2594705 | 8/1987 | France | 273/146 |

*Primary Examiner*—Benjamin H. Layno
*Attorney, Agent, or Firm*—Leon Gilden

[57] ABSTRACT

A dice member includes a first end and second end, each of an equilateral triangle configuration spaced in a parallel relationship whose base is oriented in an opposed orientation relative to the other end. Indicia imparted to the arcuate side walls at opposed ends of varying enumeration adjacent opposed ends of each side wall.

7 Claims, 4 Drawing Sheets

DICE CONSTRUCTION

BACKGROUND OF THE INVENTION

1. Field of the Invention

The field of invention relates to dice members, and more particularly pertains to a new and improved dice construction wherein the same is arranged to accentuate chance in attaining varying enumerations of the throw of the dice.

2. Description of the Prior Art

Dice members of various types have been utilized in the prior art utilizing various designations and the like. The prior art has heretofore been of typical six-sided construction but of equal square configuration. In the advent of varying types of games, varying dice have been utilized, wherein the instant invention attempts to address deficiencies of the prior art dice members by providing for a dice member that very randomly attains differing designations.

U.S. Pat. No. 4,874,175 to Fischer sets forth a dice member having trapezoidal sides.

U.S. Pat. No. 262,726 indicate the use of dice member construction of varying designations for indicia.

U.S. Pat. No. 3,608,905 to Edison sets forth a dice member utilizing a dodecaheron with twelve flat surfaces.

Accordingly, it may be appreciated that there continues to be a need for a new and improved dice construction as set forth by the instant invention which addresses both the problems of ease of use as well as effectiveness in construction in randomly attaining numerical designations and in this respect, the present invention substantially fulfills this need.

SUMMARY OF THE INVENTION

In view of the foregoing disadvantages inherent in the known types of dice construction now present in the prior art, the present invention provides a dice construction wherein the same utilizes end walls of equilateral, inverted, triangular orientation having arcuate side walls extending therebetween, with varying designations at each end of each side wall. As such, the general purpose of the present invention, which will be described subsequently in greater detail, is to provide a new and improved dice construction which has all the advantages of the prior art dice construction and none of the disadvantages.

To attain this, the present invention provides a dice member including a first end and second end, each of an equilateral triangle configuration spaced in a parallel relationship relative to the other end. Indicia imparted to the arcuate side walls at opposed ends of varying enumeration adjacent opposed ends of each side wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dice construction which has all the advantages of the prior art dice construction and none of the disadvantages.

It is another object of the present invention to provide a new and improved dice construction which may be easily and efficiently manufactured and marketed.

It is a further object of the present invention to provide a new and improved dice construction which is of a durable and reliable construction.

An even further object of the present invention is to provide a new and improved dice construction which is susceptible of a low cost of manufacture with regard to both materials and labor, and which accordingly is then susceptible of low prices of sale to the consuming public, thereby making such dice construction economically available to the buying public.

Still yet another object of the present invention is to provide a new and improved dice construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
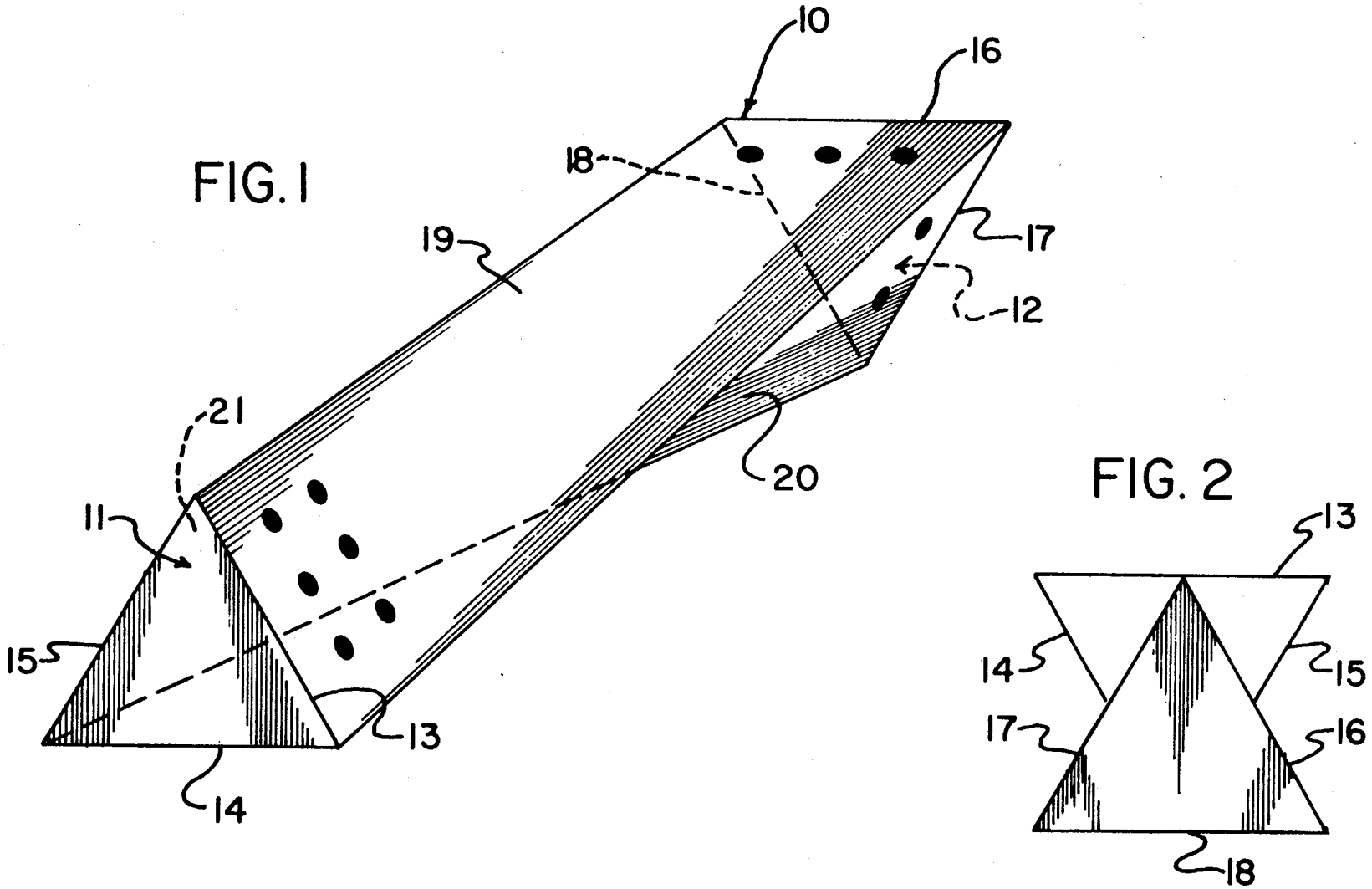
FIG. 1 is an orthographic illustration of the instant invention.
FIG. 2 is an orthographic diagrammatic view of relative orientation of the end walls relative to one another.
Figure 3:
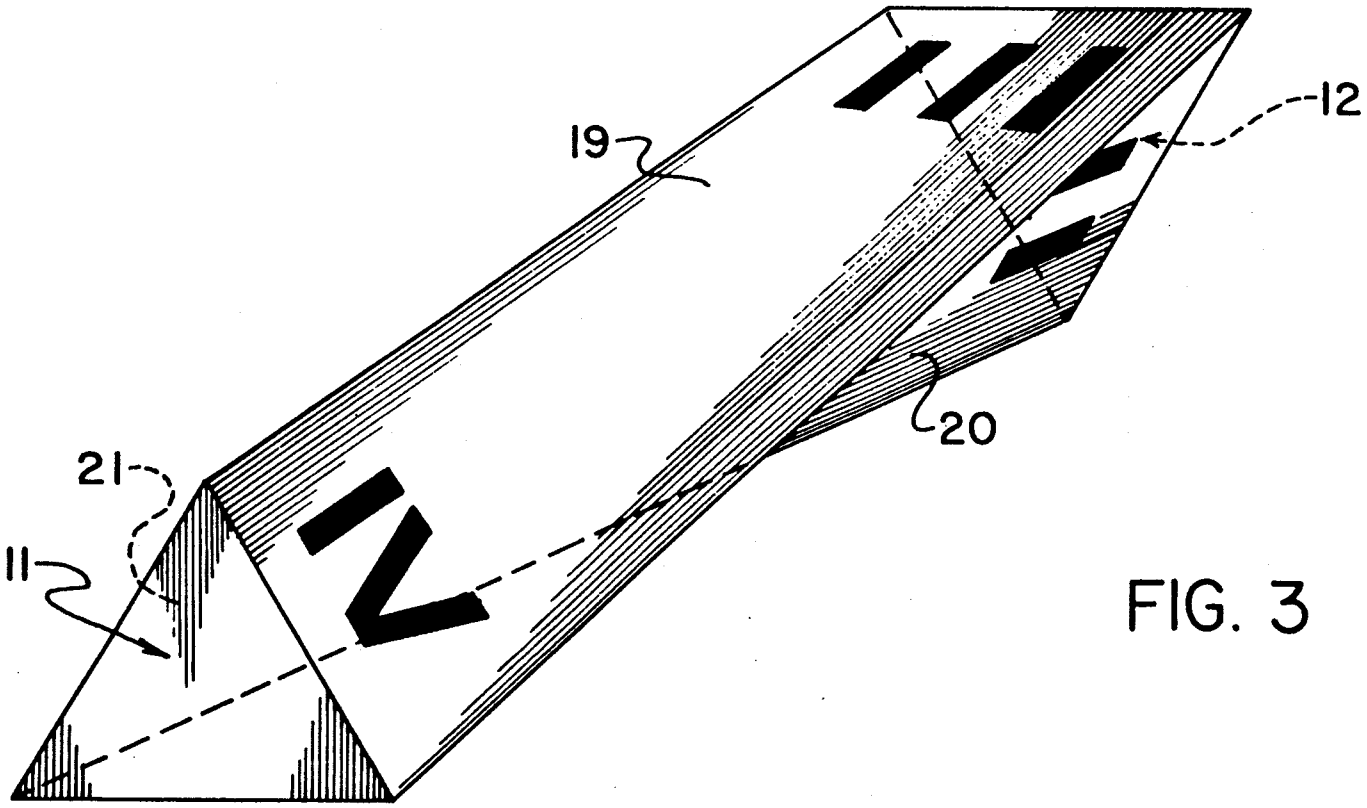
FIG. 3 is an isometric illustration of the invention utilizing Roman numeral designations relative to opposed end walls.
Figure 5:
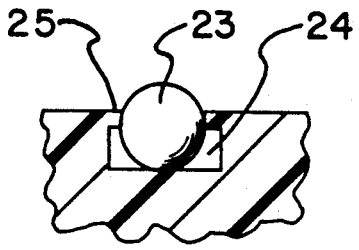
FIG. 5 is an orthographic view, taken along the lines 5—5 of FIG. 4 in the direction indicated by the arrows.

With reference now to the drawings, and in particular to FIGS. 1 to 7 thereof, a new and improved dice construction embodying the principles and concepts of the present invention and generally designated by the reference numerals 10, 10*a*, and 10*b* will be described.

More specifically, the dice construction 10 of the instant invention includes a five-sided die member having a first equilateral triangular end wall 11 spaced from and parallel a second equilateral triangular end wall 12. The first end wall 11 is rotated relative to the second end wall 12, wherein the first end wall includes first end wall first side wall, second side wall, and third side wall 13, 14, and 15. The second end wall 12 is configured by a second end first side wall 16, second side wall 17, third side wall 18 of the second end. The first end first side wall 13 is oriented such that the second end wall is rotated sixty degrees relative to the first end wall.

A first arcuate side wall 19 extends from the first end first side wall 13 to the second end first side wall 16. A second arcuate side wall 20 extends from the first end second side wall 14 to the second end second side wall 17, and similarly, a third arcuate side wall 21 extends from the first end third side wall 15 to the second end third side wall 18. As illustrated, the dice construction 10, due to the arcuate rotation of the sides, enhances rotation to further provide for an element of chance in attaining various numerical designations relative to indicia. To this end, varying indicia are positioned on each respective side wall of varying numerical designation relative to the first and second end walls.

Figure 4:
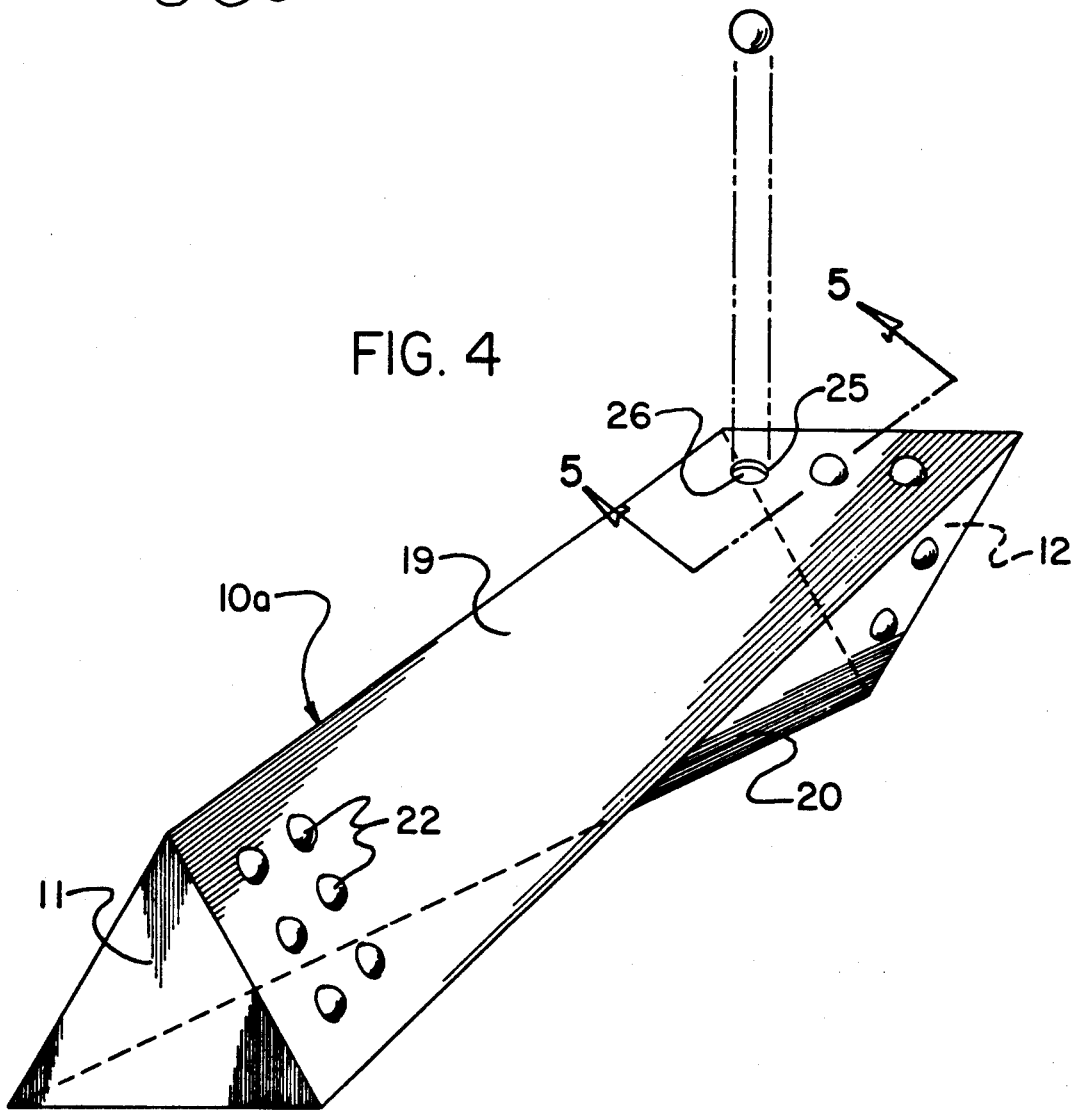
FIG. 4 is an isometric illustration of a modified aspect of the invention.

The FIG. 4 utilizes first indicia spheres 22 in each side wall adjacent the first end wall, and second indicia spheres 23 of a varying quantity relative to a respective side wall. Each of the indicia spheres are mounted within indicia sphere sockets 24, wherein each indicia sphere is of a predetermined diameter and the socket is of a predetermined height less than the predetermined diameter but greater than one-half the predetermined diameter. An annular flange 25 positioned at an upper distal end of the socket 24 coplanar with a respective side wall has a flange opening 26 defined by a predetermined second diameter less than the first diameter to secure each indicia sphere within each socket. In this manner, the resilient spheres enhance bouncing when impacted during a rolling procedure to further effect chance development and generation of the upper orientation of the dice member.

Figure 7:
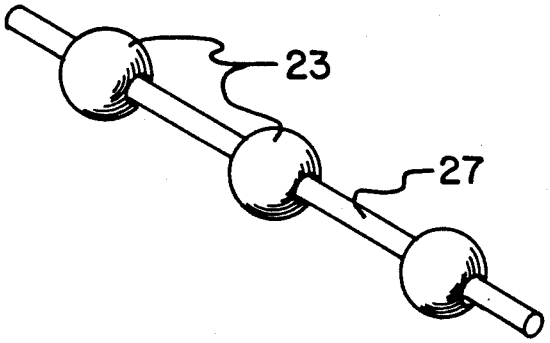
FIG. 7 is an isometric illustration of an axle rod mounting rotatably resilient indicia spheres thereon for positioning within the side walls of the dice construction of the invention.
Figure 6:
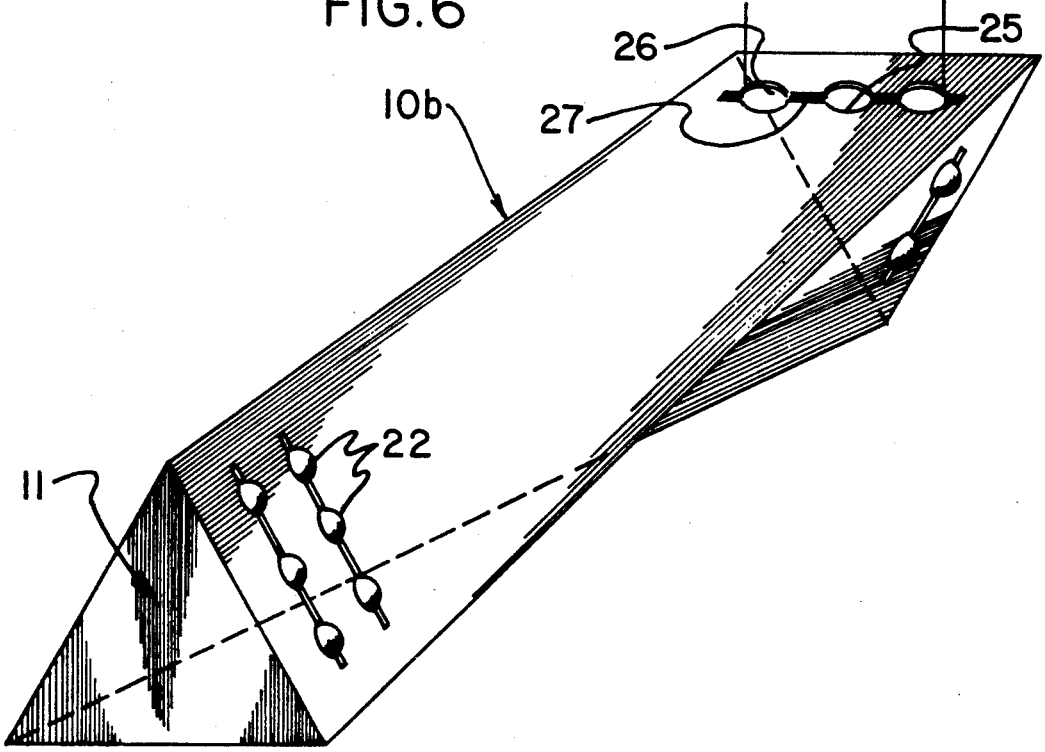
FIG. 6 is an isometric illustration of a yet further modified aspect of the invention.

FIGS. 6 and 7 indicate the dice construction 10*b*, wherein the indicia sphere sockets 24, and more specifically the flange openings 26, interconnected by an elongate axle rod slot 28 fixedly receiving an axle rod 27 therewithin. Each of the resilient indicia spheres are rotatably mounted about the axle rod to enhance rotation and rolling of the dice members as well as a bouncing during throwing of the dice to generate a random number by the indicia spheres 23.

It should be noted that due to the inversion of the first end wall relative to the second end wall, only one set of indicia is oriented in a generally horizontal orientation relative to an underlying support surface for the dice construction. In this manner, the six designations of indicia or other associated configurations are such that only one such designation will be oriented in the horizontal orientation, such as indicated in the FIGS. 1, 3, 4, and 6.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dice construction, comprising, a first end wall configured as a first equilateral triangle, and a second end wall configured as a second equilateral triangle, wherein the first end wall includes a first end wall first side, a first end wall second side, and a first end wall third side, and wherein the second end wall includes a second end wall first side, second end wall second side, and a second end wall third side, wherein each side is of an equal predetermined length, and a plurality of arcuate side walls interconnecting the first end wall relative to the second end wall.

2. A dice construction as set forth in claim 1 wherein the first end wall is arranged in a parallel and coextensive relationship relative to the second end wall, and wherein the first end wall is rotated sixty degrees relative to the second end wall.

3. A dice construction as set forth in claim 2 wherein said arcuate side walls include a first arcuate side wall extending from the first end wall first side wall to the second end wall first side wall, and a second arcuate side wall extending from the first end wall second side wall to the second end wall second side wall, and a third arcuate side wall extending from the first end wall third side to the second end wall third side.

4. A dice construction as set forth in claim 3 including first indicia oriented within each arcuate side wall adjacent the first end wall, and second indicia oriented within each arcuate side wall adjacent the second end wall, wherein the first indicia and the second indicia are of varying enumeration relative to one another.

5. A dice construction as set forth in claim 4 wherein the first indicia and the second indicia each include a predetermined number of indicia spheres, and each indicia sphere of said indicia spheres includes an indicia sphere socket positioned within said arcuate side walls, the indicia spheres are each of a predetermined first diameter, and each indicia socket is of a predetermined height less than the first diameter and greater than one-half said first diameter, and each socket includes an annular flange in a coplanar relationship relative to a respective side wall of said arcuate side walls, wherein the annular flange defines a flange opening of a second diameter less than the first diameter to capture said sphere within said socket.

6. A dice construction as set forth in claim 5 wherein the indicia spheres are each of a resilient construction.

7. A dice construction as set forth in claim 6 wherein each of said indicia spheres includes an elongate axle rod directed diametrically therethrough, wherein the indicia spheres are rotatably mounted about said axle rod, and each flange opening is diametrically bisected to include a rod slot bisecting each said flange opening and the elongate axle rod is mounted within said slot.

* * * * *